US006536077B1

(12) United States Patent
Espey

(10) Patent No.: US 6,536,077 B1
(45) Date of Patent: Mar. 25, 2003

(54) SELF-LUBRICATED WHEEL ASSEMBLY

(75) Inventor: Carl R. Espey, Fairview Park, OH (US)

(73) Assignee: Creco Corporation, Seville, OH (US)

( * ) Notice: Subject to any disclaimer, the term of this patent is extended or adjusted under 35 U.S.C. 154(b) by 0 days.

(21) Appl. No.: 09/662,099

(22) Filed: Sep. 14, 2000

(51) Int. Cl.[7] ..... A47H 15/00

(52) U.S. Cl. ..... 16/91; 16/106; 16/107; 49/420

(58) Field of Search ..... 16/91, 107, 106, 16/97; 49/420, 424, 426

(56) References Cited

U.S. PATENT DOCUMENTS

| | | | | |
|---|---|---|---|---|
| 313,085 | A | * | 3/1885 | Lawrence |
| 538,691 | A | * | 4/1895 | McGill |
| 2,523,935 | A | * | 9/1950 | Austin |
| 2,625,221 | A | | 1/1953 | McKee et al. |
| 3,176,757 | A | | 4/1965 | Lomaz |
| 3,365,253 | A | | 1/1968 | Haller |
| 4,120,072 | A | * | 10/1978 | Hormann |
| 4,178,856 | A | | 12/1979 | Dunville |
| 4,249,649 | A | * | 2/1981 | Kraft |
| 5,120,091 | A | | 6/1992 | Nakagawa |
| 5,129,738 | A | | 7/1992 | Nakagawa |
| 5,624,887 | A | * | 4/1997 | Nakamaru et al. |
| 5,704,718 | A | | 1/1998 | Mori et al. |

* cited by examiner

*Primary Examiner*—Gary Estremsky
*Assistant Examiner*—Mark Williams
(74) *Attorney, Agent, or Firm*—Rankin, Hill, Porter & Clark LLP

(57) ABSTRACT

A wheel assembly adapted to travel along guide rails or tracks. The assembly includes a roller formed of porous sintered metal, a shaft attached to a supporting body and an adapter to which both the roller and shaft are connected. The adapter includes a cylindrical inner portion with an axial socket to receive the shaft and a cylindrical inner portion of a smaller diameter to define an annular inner shoulder. A spring retainer secures the roller to the adapter.

8 Claims, 2 Drawing Sheets

SELF-LUBRICATED WHEEL ASSEMBLY

BACKGROUND OF THE INVENTION

This invention relates to wheel assemblies and particularly to guide rollers that travel along guide rails or tracks such as in the case of segmented overhead doors and overhead trolley conveyors. More particularly, the invention relates to a wheel-assembly having a flexible design that permits variations in the length of the supporting shaft and size of roller, dimensions while using many of the same basic components.

Various types of wheel-assemblies have been used in connection with segmented overhead doors such as for garages and various types of cargo trucks. These assemblies usually have a roller that travels on a guide rail or track.

Problems have arisen due, for example, to vibration and irregular stresses that are induced during opening and closing of a segmented door. Failures can also occur due to excessive end thrusts against the bearings. Furthermore, it is difficult to find an effective means for journaling the wheel assembly in brackets located on the particular structure to be moved and guided. Another problem is the formation of rust that can occur due to exposure to weather conditions. Still another problem is that of providing lubrication for the bearing surfaces.

The wheel assembly of the present invention resolves many of the difficulties described above and affords other features and advantages heretofore not obtainable.

SUMMARY OF THE INVENTION

It is among the objects of invention to provide a novel wheel assembly of improved reliability and improved resistance to corrosion and wear due to conditions of use. Still another object is to provide a wheel assembly of simplified design that lends itself to automated assembly. These and other objects and advantages are achieved with the unique roller assembly of the present invention which is especially adapted for use in connection with segmented doors.

The assembly includes as one of its primary components, a unique adaptor having an inner end portion that is tubular and provided with an axial socket, and a cylindrical outer end portion that provides a bearing surface and that has a diameter smaller than that of the inner cylindrical portion. The two portions thus define a retainer shoulder between them. A roller formed of porous sintered metal impregnated with a lubricant is mounted on the outer bearing portion of the adaptor and is located adjacent to the shoulder. A spring retainer is forced onto the projecting end of the cylindrical end portion so that the roller is retained between the shoulder and the spring retainer.

An elongated shaft is forced into the socket formed in the inner end portion of the adaptor to complete the assembly. The socket is provided with axially extending ribs that grip the end of the shaft to assure that the assembly is tightly retained on the shaft with an interference fit.

In accordance with one aspect of the invention, washers or spacers formed of polyethylene are positioned on opposite sides of the roller in engagement with the shoulder and the retainer spring respectively. Also, the bore in the roller is provided with a plurality of axially extending grooves that serve to collect any debris that may get into the assembly.

DESCRIPTION OF THE PREFERRED EMBODIMENT

Figure 1:
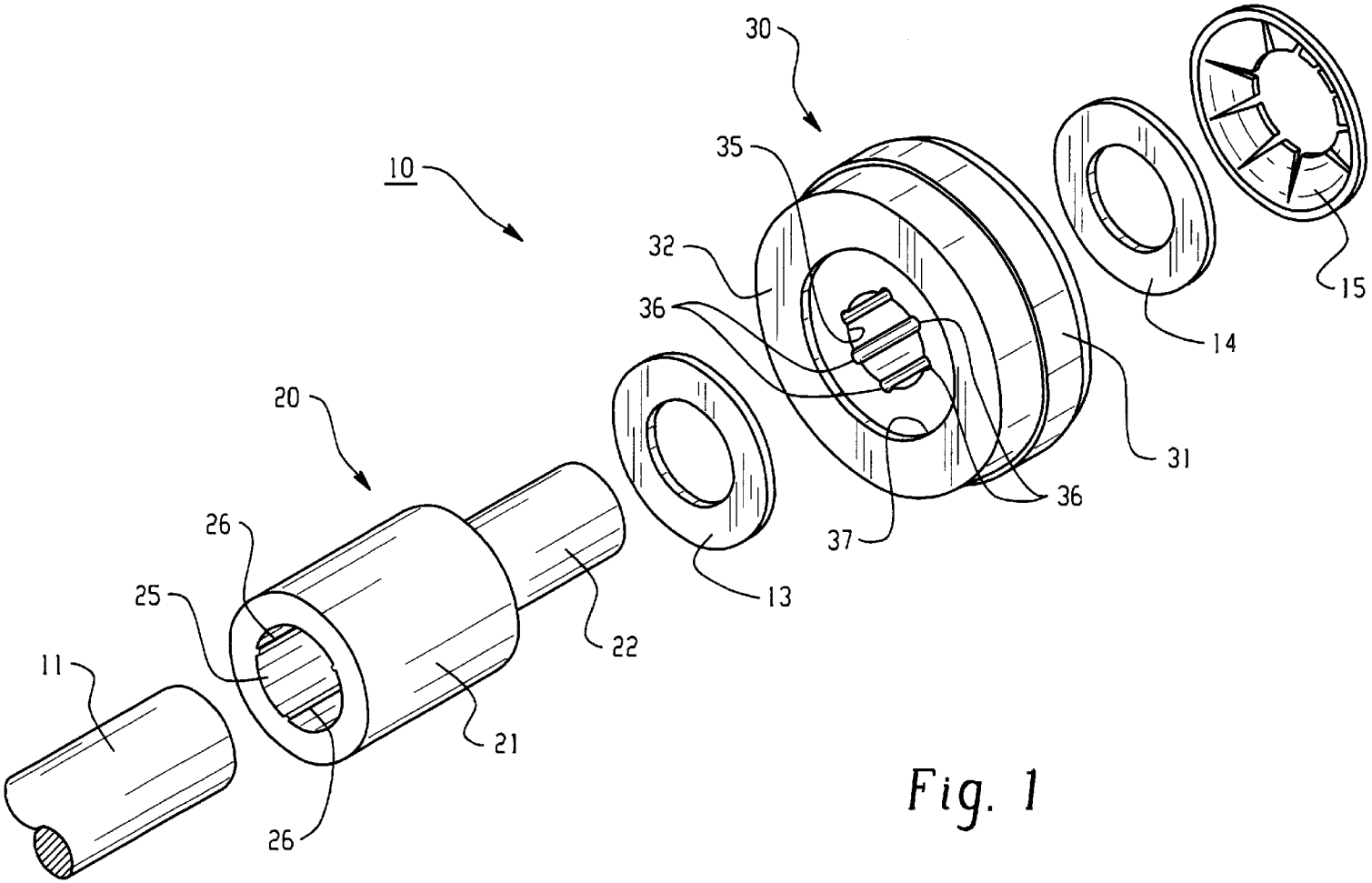
FIG. 1 is an exploded perspective view showing the various components of the assembly axially aligned so as to provide a representation of the various components in relation to the manner and order in which they are assembled.
Figure 3:
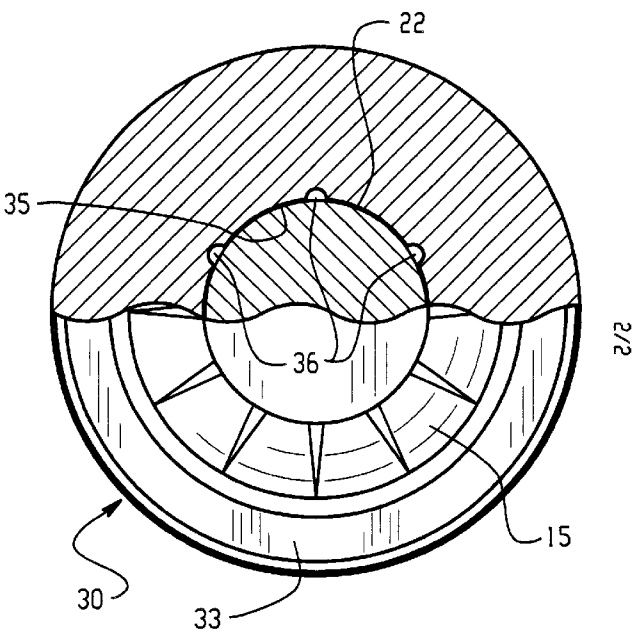
FIG. 3 is a side elevation of the roller assembly with parts broken away and shown in section in the manner indicated by he lines 3—3 of FIG. 2.
Figure 2:
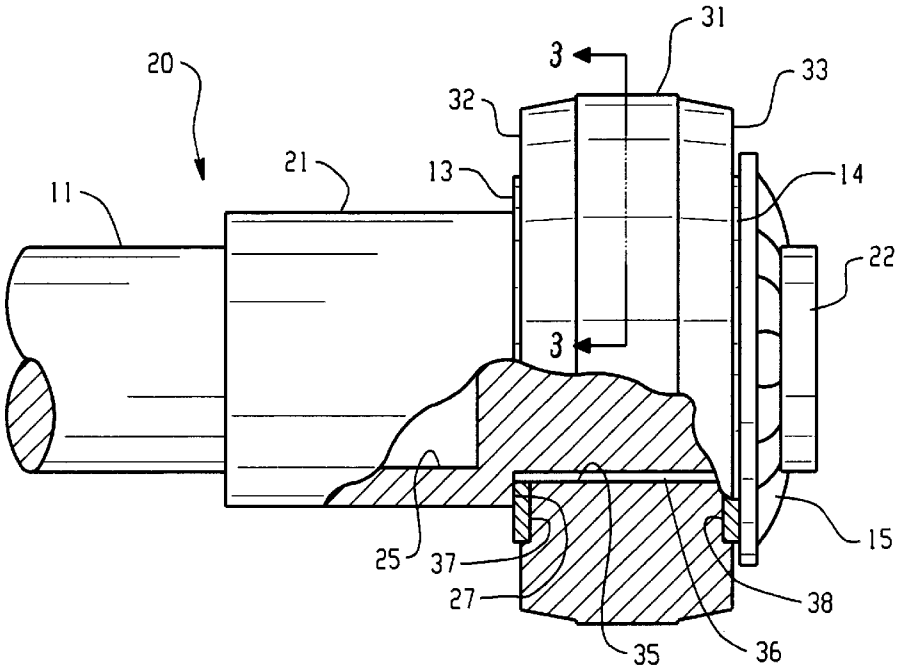
FIG. 2 is an end elevation of the wheel assembly with parts broken away and shown in section for the purpose of illustration.

In the overall assembly of the device 10, the primary components include an adaptor 20, and a roller 30 formed of sintered metal. The adaptor 20 is mounted on a shaft 11 which is mounted such as by brackets on the!structure to be supported and guided by a plurality of the wheel assemblies 10. The assembly also includes a pair of low friction washers 13,14 and a spring retainer 15 to be assembled in a manner to be described below.

The adaptor 20 includes an inner cylindrical portion 21 and an outer cylindrical portion 22. The inner cylindrical portion 21 has a relatively large diameter and is provided with an[ a]xial socket 25 adapted to receive an end of the shaft 11 which is tightly retained therein. The socket 25 is provided with three axially extending ridges or ribs 26 that serve to grip the surface of the shaft 11 and thus provides firm retention on the adaptor.

The outer cylindrical portion 22 has a smaller diameter than that of the inner cylindrical portion 21 and thus defines an annular shoulder 27 that separates the inner and outer portions 21 and 22. Also, the outer cylindrical portion defines a bearing surface for the roller 30. The adaptor is preferably formed of case-hardened steel such as No. 1010 or No. C1038.

By using the adaptor as part of the assembly, increased flexibility is afforded in that shafts of various length can be selected to accommodate different applications and also rollers of various outer diameters can be used according to the requirements of a particular application.

The roller 30 is formed of oil-impregnated sintered metal. Accordingly when the metal particles are sintered the voids are filled with a liquid lubricant to provide extremely effective lubrication capabilities during use.

The roller has a circumferential tread portion 31, opposed side walls 32 and 33 and an axial bore 35 adapted to be rotatably mounted on the outer cylindrical portion 22 of the adaptor 20. The bore 35 is provided with longitudinal grooves or slots 36 that serve to collect any debris that intrudes into the assembly.

The side walls 32 and 33 are each provided with a circular recess 37, 38 respectively adapted to accommodate washers 13 and 14 respectively. The washer 13 bears against the shoulder 27 so as to prevent any abrasion between the side wall 32 of the roller and the shoulder 27. Washers 13 and 14 comprise a nonmetallic material. Preferably, washers 13 and 14 comprise a polymer material. Examples of suitable polymer materials include thermoplastic materials such as nylons, ethylene copolymers, olefinic materials such as propylene homopolymers and copolymers, halogenated materials including PTFE and PVC. A preferred material for use in forming washers 13 and 14 is polyethylene.

The washer 14 is located between the recess 38 and the spring retainer 15 which is forced over the outer end of the outer portion 22 of the adaptor 20. The spring retainer is so assembled as to permit some slight axial movement of the roller on the bearing surface of the adaptor 20. Preferably the outer edge of the outer end portion of the adapter is rolled back slightly to provide a mechanical lock.

With this design, lubricant from the internal reservoirs in the sintered metal can migrate to the working surface of the roller and provide a continuous lubrication over the life of the assembly.

The resulting design is of simplified construction as compared to prior art wheel assemblies of this type and lends itself to automatic assembly processes. Accordingly, the assembly has a reduced cost of manufacture and greatly improved flexibility that permits the basic components to accommodate a variety of dimensional variations according to particular applications.

The assembly 10 of the present invention is especially well suited for use as the roller assembly in an overhead or garage door. Applicant hereby incorporates by reference the teachings of U.S. Pat. Nos. 3,176,757 and 2,625,221 which disclose the general configuration of an overhead door in which assembly 10 may easily be employed. Applicant's assembly 10 would be used in place of the conventional rollers that engage the guide track of the overhead door assembly.

While the invention has been shown and described with respect to a particular embodiment thereof, this is intended for the purpose of illustration rather than limitation and other variations and modifications of the particular device herein shown and described will be apparent to those skilled in the art all with the intended spirit and scope of the invention. Accordingly the patent is not to be limited in scope and effect to the particular embodiment herein shown and described nor in any other way that is inconsistent with the extent to which the progress of the art has been advanced by the invention.

What is claimed is:

1. A wheel assembly for linear travel along a guide way while connected to a supporting body to facilitate movement thereof comprising:

a roller formed of porous sintered metal and defining an axial bore;

a shaft attached to said supporting body;

an adaptor having a cylindrical inner end portion with an axial socket formed therein having axially extending ribs, and a cylindrical outer end portion having a diameter smaller than that of said inner end portion to define an annular shoulder between said end portions; and a spring retainer mounted on the outer end of said outer end portion of said adapter; said roller being journaled on said outer end portion of said adapter and axially retained thereon between said shoulder and said spring retainer, and said shaft having an end portion tightly received and gripped by the axially extending ribs of said socket of said inner end portion of said adapter.

2. A wheel assembly as defined in claim 1 wherein said spring retainer is an annular spring retainer and said outer end portion of said adapter is rolled over to provide a mechanical lock.

3. A wheel assembly as defined in claim 1 wherein said roller is formed of sintered metal having voids therein filled with a lubricant.

4. A wheel assembly as defined in claim 3 wherein said roller is impregnated with a liquid lubricant.

5. A wheel assembly as defined in claim 1 wherein said axial bore in said roller has axially extending grooves formed therein to collect any debris that may intrude into the assembly.

6. A wheel assembly as set forth in claim 1 including a pair of nonmetallic washers disposed on each side of said roller.

7. An overhead door having a wheel assembly as defined in claim 1 and a guide track, said roller being in rolling engagement with said guide track.

8. A wheel assembly for linear travel along a guide way while connected to a supporting body to facilitate movement thereof comprising:

a roller having an axial bore;

a shaft attached to said supporting body;

an adaptor having a cylindrical inner end portion with an axial socket formed therein having axially extending ribs, and an outer end portion having a diameter smaller than that of said inner end portion to define an annular shoulder between said end portions; and said roller being journaled on said outer portion of said adaptor and axially retained thereon;

said shaft having an end portion tightly received and gripped by the axially extending ribs of said socket of said inner end portion of said adaptor.

* * * * *